United States Patent [19]

Gilmore

[11] Patent Number: 4,962,295

[45] Date of Patent: Oct. 9, 1990

[54] INCANDESCENT HEATING UNIT

[76] Inventor: Joseph D. Gilmore, Rte. 6, Box 379-A, Lancaster, S.C. 29720

[21] Appl. No.: 354,475

[22] Filed: May 19, 1989

[51] Int. Cl.[5] ..... H05B 3/44

[52] U.S. Cl. ..... 219/217; 219/220; 219/201; 219/521; 219/422

[58] Field of Search ..... 219/217, 220, 347, 354, 219/521, 346, 200, 201, 385, 386, 205, 461, 552; 5/421, 422; 297/180

[56] References Cited

U.S. PATENT DOCUMENTS

| | | | |
|---|---|---|---|
| 1,307,615 | 6/1919 | Buchanan | 219/521 |
| 1,521,394 | 12/1924 | Sanford | 219/220 |
| 1,526,132 | 2/1925 | Gilger | 219/217 |
| 2,467,479 | 4/1949 | Huck | 219/347 |
| 2,488,964 | 11/1949 | Conrad | 219/217 |
| 2,587,731 | 3/1952 | Irving | 219/217 |
| 3,194,944 | 7/1965 | Papp | 219/205 |
| 3,394,243 | 7/1968 | Lee | 219/205 |

FOREIGN PATENT DOCUMENTS

| | | | |
|---|---|---|---|
| 1027859 | 4/1958 | Fed. Rep. of Germany | 219/217 |
| 556685 | 10/1943 | United Kingdom | 219/217 |

*Primary Examiner*—Teresa J. Walberg
*Attorney, Agent, or Firm*—Clifton T. Hunt

[57] ABSTRACT

An incandescent heating unit uses a low wattage incandescent light bulb to warm the occupant of a metal chair. The light bulb generates heat which is absorbed by the metal and radiated to the occupant. A dispersion disk spaced between the bulb and the chair prevents the formation of a hot spot in the portion of the chair nearest the bulb.

7 Claims, 1 Drawing Sheet

INCANDESCENT HEATING UNIT

FIELD OF THE INVENTION

This invention relates to an incandescent heating unit for warming the occupant of a conventional metal folding chair.

BACKGROUND OF THE INVENTION

It is known to use incandescent light bulbs for warming the occupant of furniture. See, for example, eleven of the patents that issued between 1924 and 1949 showing the use of incandescent light bulbs for warming the occupants of beds:

| PATENT NO. | ISSUE DATE | INVENTOR | TITLE |
|---|---|---|---|
| 1,486,412 | Mar 11, 1924 | Biddlecom | ELECTRIC BED WARMER |
| 1,500,696 | July 8, 1924 | White | FOOT WARMER |
| 1,622,326 | Mar 29, 1927 | Lister | ELECTRIC BED WARMER |
| 1,796,761 | Mar 17, 1931 | O'Brien | HEATER |
| 1,814,940 | July 14, 1931 | Long | BED WARMER |
| 2,234,303 | Mar 11, 1941 | Gray | HEAT RADIATING DEVICE |
| 2,258,944 | Oct 14, 1941 | Bethell | BED WARMER |
| 2,434,188 | Jan 6, 1948 | Winn | FOOT WARMER |
| 2,452,234 | Oct 26, 1948 | Gerdes | BED HEATER |
| 2,487,478 | Nov 8, 1949 | Roberts | BED WARMER |
| 2,490,910 | dEC 13, 1949 | Latta | ELECTRIC BED WARMER |

Incandescent light bulbs have also been used for heating or warming other household items, such as a hot water bottle (U.S. Pat. No. 849,368); and food (U.S. Pat. Nos. 1,630,237, 1,712,330, 2,292,992, 2,413,176, 2,535,500, and 3,120,599).

The economical advantages of using the heat inherently generated by the inexpensive operation of an incandescent light bulb have been recognized, but the combination of an incandescent light bulb with a metal chair to radiate the heat and effectively warm the occupant of the chair has not heretofore been known, to applicant's knowledge.

SUMMARY OF THE INVENTION

It is, therefore, an object of the invention to provide, in combination, a conventional metal folding chair and a conventional low wattage incandescent light bulb arranged to radiate the heat from the bulb throughout the metal seat of the chair to effectively warm the occupant of the chair. Supplemental or alternative heat may be obtained by arranging a second low wattage incandescent light bulb to radiate heat throughout the metal backrest of the chair.

The conventional metal folding chair to which reference is made herein has a sheet metal seat and a sheet metal back rest supported on pivotally interconnected tubular legs. Other chairs with a metal seat and/or a metal backrest are also usable in practicing the invention.

In the illustrated embodiment, twenty-five watt incandescent bulbs are housed within reflectors beneath the seat and behind the back of the chair. The invention may be practiced successfully with only one twenty-five or other low wattage bulb arranged in operative relation with either the seat or the backrest of the chair.

Twenty-five watt bulbs are preferred because they are economical to operate and have the additional advantage of being self regulating. The wattage is high enough to provide adequate heat and low enough to prevent the bulb from generating enough heat to make the chair uncomfortably hot, no matter how long the bulb burns.

A dispersion disk is spaced between the bulb and the chair to prevent the formation of a localized hot spot in the portion of metal nearest the bulb, and to evenly disperse the heat radially across the proximal portion of the chair. The heat is gradually absorbed by the metal and radiates into the body of the chair's occupant.

DETAILED DESCRIPTION OF THE INVENTION

Figure 1:
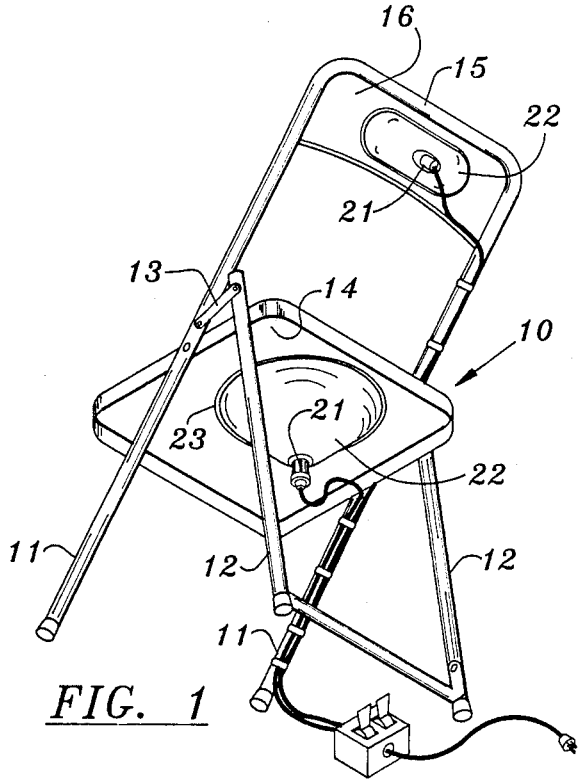
FIG. 1 is a perspective view looking up at the bottom and rear of a conventional metal folding chair and illustrating the arrangement of reflectors used to direct the heat from incandescent bulbs against the metal seat and metal back of the chair.

Referring more specifically to the drawings, the numeral 10 broadly indicates a conventional metal folding chair. The conventional metal folding chair of the illustrated embodiment comprises tubular front legs 11 and rear legs 12 which are pivotally interconnected as by links 13 at the sides of the chair. The front legs 11 extend upwardly above a metal seat 14 and are joined together by a web 15 above a metal backrest 16. The seat 14 and backrest 16 are formed from sheet metal of a suitable gauge to support an occupant of the chair.

It has been found that the metal in the seat and backrest of the chair will gradually absorb the heat generated by the operation of a low wattage incandescent light bulb and radiate the absorbed heat into an occupant of the chair to effectively warm the occupant.

The heated chair has therapeutic utility for relieving the discomfort of muscular aches and arthritis. It may also be used to provide welcome low-cost heat for the indigent and elderly.

In the illustrated embodiment, the chair seat 14 and backrest 16 are heated by twenty-five (25) watt bulbs 20 which are mounted in sockets 21 and surrounded by reflectors 22. The rims of the reflectors are wrapped around magnetically charged retaining rings, only one of which is shown at 23. The rings 23 are magnetically attached beneath the metal seat 14 and behind the metal backrest 16 to hold the reflectors snugly against corresponding parts of the chair, as shown in FIG. 1.

Dispersion disks 24 are supported in spaced relation between the bulbs 20 and the proximal portions of the chair to dissipate the heat radially across the metal and prevent the build-up of a localized hot spot in the metal adjacent the bulb.

Figure 2:
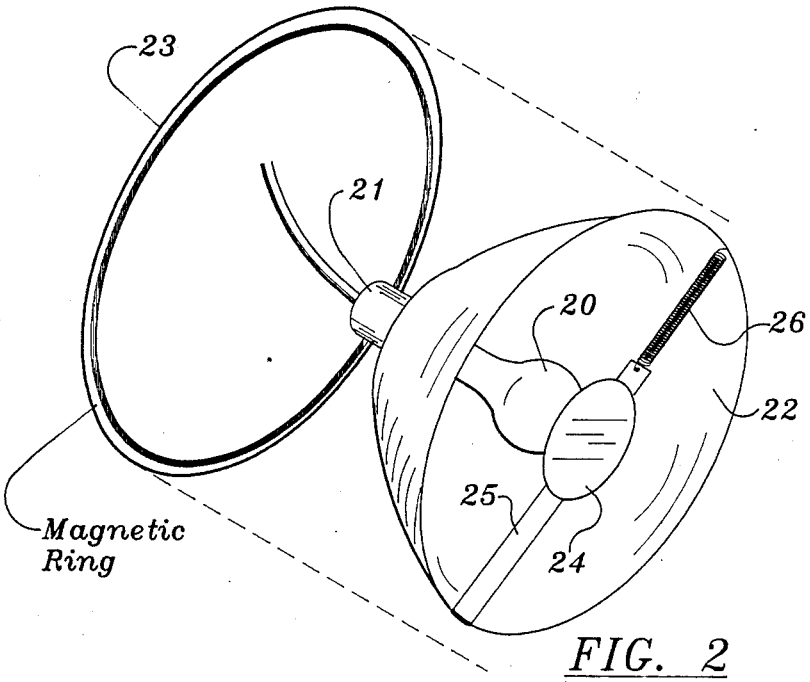
FIG. 2 is an exploded perspective view of the reflector and its attachment ring removed from the seat of the chair and illustrating the operative positions of the incandescent light bulb, reflector, and dispersion disk.

The dispersion disks are supported in the operative position of FIGS. 1 and 2 by metal straps 25 and springs 26 connected diametrically to the rim of the reflector or its retaining ring 23. The disks 24 may be removed to replace the light bulbs when desired or needed.

The sockets for the bulbs are connected by wires 30 to a suitable source of electrical energy and operation of the bulbs are independently controlled by switches 31 easily accessible to the chair occupant.

The use of an incandescent 25 watt light bulb for heating has the additional advantage of being self-regulating; meaning that the low wattage prevents the bulb from generating enough heat to make the chair uncomfortably hot, no matter how long it is heated in the manner described. This is an advantage when the occupant is elderly or infirm.

There is thus provided an economical and effective heating unit for a chair. Although specific terms have been used in describing the invention, they have been used in a descriptive and generic sense only and not for the purpose of limitation. It is recognized that variations in the structure and assembly of the invention may be made within the scope of the claims.

I claim:

1. In a chair of the type having a metal portion arranged to be positioned against an occupant of the chair, the combination of means for heating said metal portion of the chair to warm an occupant of the chair, said means comprising:

(a) a low wattage incandescent light bulb, (b) means connecting the light bulb to a source of electrical energy, (c) a reflector surrounding the light bulb, (d) means for holding the reflector snugly against said metal portion of the chair with the light bulb between the reflector and said metal portion of the chair, (e) a dispersion disk, and (f) means supporting the dispersion disk between the light bulb and said metal portion of the chair, whereby the light bulb can be energized to generate heat to be dispersed across said metal portion of the chair by the dispersion disk to cause said metal portion of the chair to absorb the heat and warm the occupant of the chair.

2. Apparatus according to claim 1 wherein the bulb is a twenty-five watt bulb.

3. Apparatus according to claim 1 wherein the metal portion of the chair is the seat of the chair.

4. Apparatus according to claim 1 wherein the metal portion of the chair is the backrest of the chair.

5. Apparatus according to claim 1 wherein the metal portion of the chair is the seat and the backrest of the chair.

6. Apparatus for heating a metal portion of a chair to warm an occupant of the chair, said apparatus comprising a low wattage incandescent light bulb, means connecting the light bulb to a source of electrical energy, a reflector surrounding the bulb, a magnetic retaining ring connected to the reflector and adapted to be magnetically adhered to a metal portion of a chair, a dispersion disk, and means supporting the dispersion disk in spaced relation between the bulb and the chair to which said apparatus is to be attached.

7. Apparatus for heating a metal portion of a chair to warm an occupant of the chair, said apparatus comprising a low wattage incandescent light bulb, means connecting the light bulb to a source of electrical energy, a reflector surrounding the bulb, means for holding the reflector snugly against a metal portion of a chair, a dispersion disk, and a resiliently supported strap connected to the dispersion disk and extending diametrically across the reflector to support the dispersion disk in spaced relation between the bulbs and the chair to which the apparatus is to be attached.

* * * * *